United States Patent [19]

Gifford et al.

[11] Patent Number: 4,638,825

[45] Date of Patent: Jan. 27, 1987

[54] COIN COUNTER

[75] Inventors: Michael F. Gifford, San Jose; James H. Coffman, Woodside, both of Calif.

[73] Assignee: Coffman Systems, Inc., Burlingame, Calif.

[21] Appl. No.: 750,026

[22] Filed: Jul. 1, 1985

[51] Int. Cl.[4] ..... G07D 9/00

[52] U.S. Cl. ..... 133/8 R; 194/215; 133/3 C; 133/3 D; 193/DIG. 1; 209/539

[58] Field of Search ..... 133/8 R, 8 A, 8 B, 8 C, 133/8 D, 8 E, 1 R, 2, 3 R, 3 C, 3 D, 3 H; 193/7, 44, DIG. 1; 209/539, 934; 194/DIG. 11, 215

[56] References Cited

U.S. PATENT DOCUMENTS

| | | | |
|---|---|---|---|
| 1,636,893 | 7/1927 | Biberfield | 194/DIG. 11 |
| 3,125,102 | 3/1964 | Bower | 133/8 R |
| 3,565,225 | 2/1971 | Fay | 193/7 |
| 3,752,168 | 8/1973 | Bayha | 133/3 D |
| 3,777,769 | 12/1973 | Ueno | 133/8 R |

*Primary Examiner*—Joseph J. Rolla
*Assistant Examiner*—Jay I. Alexander
*Attorney, Agent, or Firm*—Thomas E. Schatzel

[57] ABSTRACT

A coin counting device for simultaneously counting a number of coins, all of which are of a selected denomination. The device includes a hopper, an inclined planar member to receive coins from the hopper, members mounted to prevent coins from rolling down the planar member and to prevent coins from sliding down the planar member atop one another. The device also includes an array of pin members to disperse the coins transversely across the surface of the planar member. Gate means are mounted at the bottom edge of the inclined planar member to count coins as they slide passed.

19 Claims, 4 Drawing Figures

COIN COUNTER

BACKGROUND OF INVENTION

1. Field of the Invention

The present invention relates to a coin-counting device and, more particularly, to a coin-counting device of the type which counts a number of coins, all of the same denomination, at the same time.

2. Description of the Prior Art

Although various situations exist where it is desirable to count coins of the same denomination, perhaps no more difficult environment exists than in gaming machines. In such machines, especially slot machines, it is typical to provide a reservoir of coins which are to be returned, in whole or in part, to players of the machine with excess coins being retained inside the machine in a so-called "drop bucket" for "the house". In conventional gaming machines, there is no known means to reliably count those coins which are kept by the house prior to the coins being removed from the machines. A primary reason that such counting means do not exist in conventional machines is that the space within such machines is extremely limited. On the other hand, the absence of such counting means reduces control over the gaming machine and increases opportunities for pilferage and misuse of the gaming machine.

Another difficulty in providing gaming machines with means to count coins which enter the drop bucket is that the number of coins entering the bucket at any one time can be quite large, sometimes exceeding fifty or sixty coins. If the coin counting means cannot reliably count such a large number of coins essentially simultaneously, the usefulness of the counter is severely limited and, again, control over the gaming machine is decreased and opportunities for pilferage and misuse are increased.

Various coin-counting and handling devices are taught in the prior art, for example, U.S. Pat. Nos. 1,556,660; 1,563,146; 2,594,422; and 3,777,769. None of the devices in those patents appear capable, however, of reliably counting coins in a gaming machine, especially where a large number of coins are received at the same time. Among the difficulties encountered when such a large number of coins is received simultaneously is that some of the coins may begin to roll on edge, while others may begin to slide over each other. Also, if a restricted passage is provided for the coins, the coins may wedge against one another and, consequently, jam the passage.

SUMMARY OF THE INVENTION

An object of the present invention is to provide a compact device for reliably counting coins of the same denomination where a large number of such coins are received by the device at the same time.

In accordance with the preceding object, the present invention generally relates to a coin-counting device for use in, for example, a coin-activated machine of the type having a coin-receiving device for accepting coins all of the same denomination and a coin reservoir means mounted within the coin-receiving device which allows collected coins to spill over into the coin-counting device. In the preferred embodiment, the coin-counting device includes a hopper to receive coins, an inclined planar member mounted to receive, at its upper end, coins from the hopper to provide a surface for coins to slide upon; gate means mounted at spaced-apart locations transversely across the lower end of the inclined planar member to count coins sliding downward on the surface of the inclined planar member; and means mounted to extend transversely across said inclined planar member at a distance thereabove sufficient to prevent two coins from sliding, one atop the other, into the gate means. Also in the preferred embodiment, an array of spacedapart deflector members are mounted to extend downwardly toward said inclined planar member such that coins sliding down said inclined planar member strike the deflector members and, hence, are dispersed across the face of the said inclined planar member.

Accordingly, an advantage of the present invention is the provision of a compact device for reliably counting coins, all of the same denomination, where a large number of such coins are received by the device at the same time.

Another advantage of the present invention is the provision of a compact device for reliably counting coins, all of the same denomination, which is of low cost and requires no moving parts.

This and other objects and advantages of the present invention will no doubt become obvious to those of ordinary skill in the art after having read the following detailed description of the preferred embodiment which is illustrated in the various drawing figures.

IN THE DRAWINGS

DETAILED DESCRIPTION OF THE PREFERRED EMBODIMENT

Figure 1:
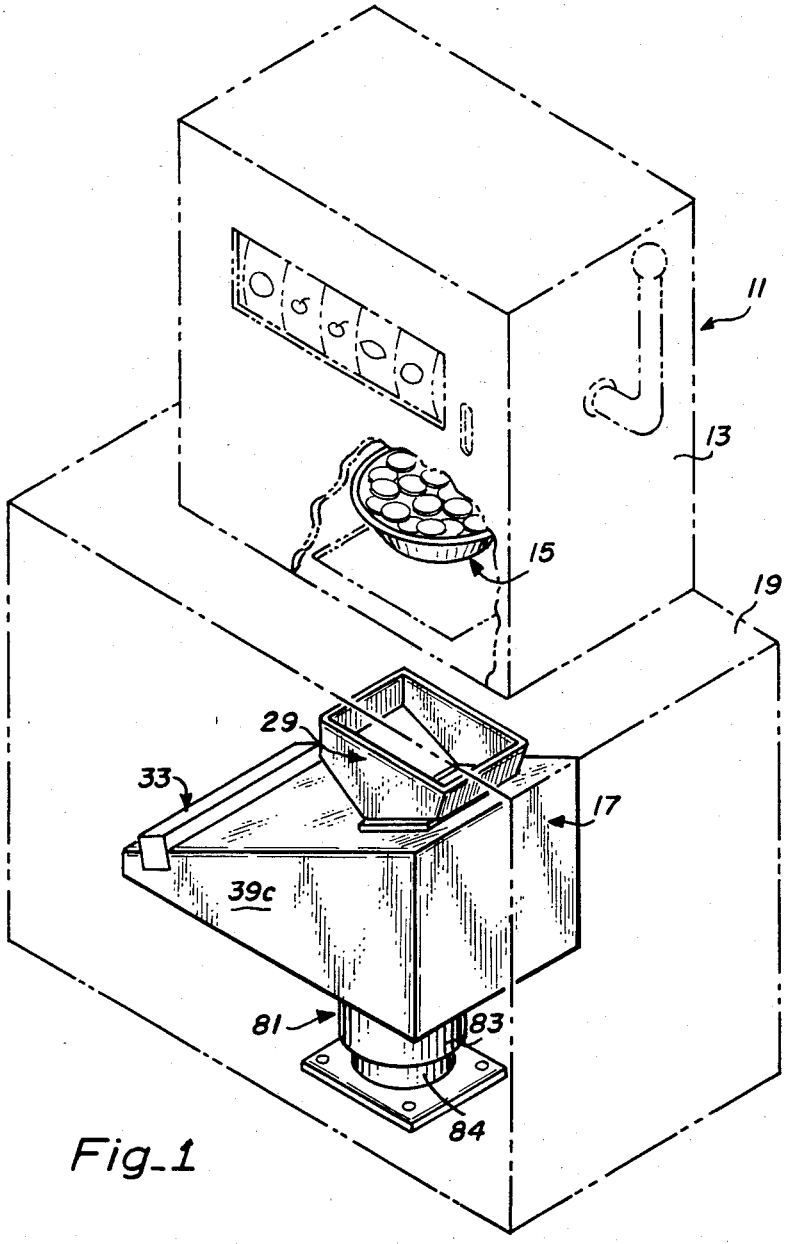
FIG. 1 is a pictorial view of a coin-activated machine, including a coin-counting device, according to the present invention.

FIG. 1 shows a coin-activated machine, generally indicated by the reference number 11, which comprises a coin-receiving device 13, a coin-reservior 15 mounted within the coin-receiving device 13 for collecting a quantity of the coins which have been inserted into the coin-receiving device 13, and a coin-counting device 17 mounted in an enclosure 19 for receiving and counting coins which spill over from the reservior 15. The coin-counting device 17 counts coins all of the same denomination and, accordingly, the coin-activated machine 11 is of the type which receives only coins of the same denomination. For example, the coins could all be dimes, nickels, or quarters In practice, the coin-activated machine 11 typically would be a gaming device such as a slot machine in which the coin-reservoir 15 is a dish-shaped member which receives coins which have been paid into the gaming device. In such gaming devices, most of the coins in the reservoir 15 are utilized by the gaming device as payouts to a player; however, after the reservoir is filled with coins, any overflow is not returned to players of the machine, but is collected in the enclosure 19. Thus, the purpose of the coin-counting device 17 is to provide a count or tabulation of all of the coins which enter the enclosure 19.

It should be appreciated that the coin-activated machine 11 need not be a gambling or gaming machine, but could be a vending machine of any type which receives coins all of the same denomination. Further, it should be appreciated that the term "coins" as used herein can include tokens, whether metal or non-metal. Still further, although the coin-counting device 17 finds particular utility with regard to gaming machines of the type including a reservoir 15, it could be utilized to count coins or tokens in other types of vending machines.

Figure 2:
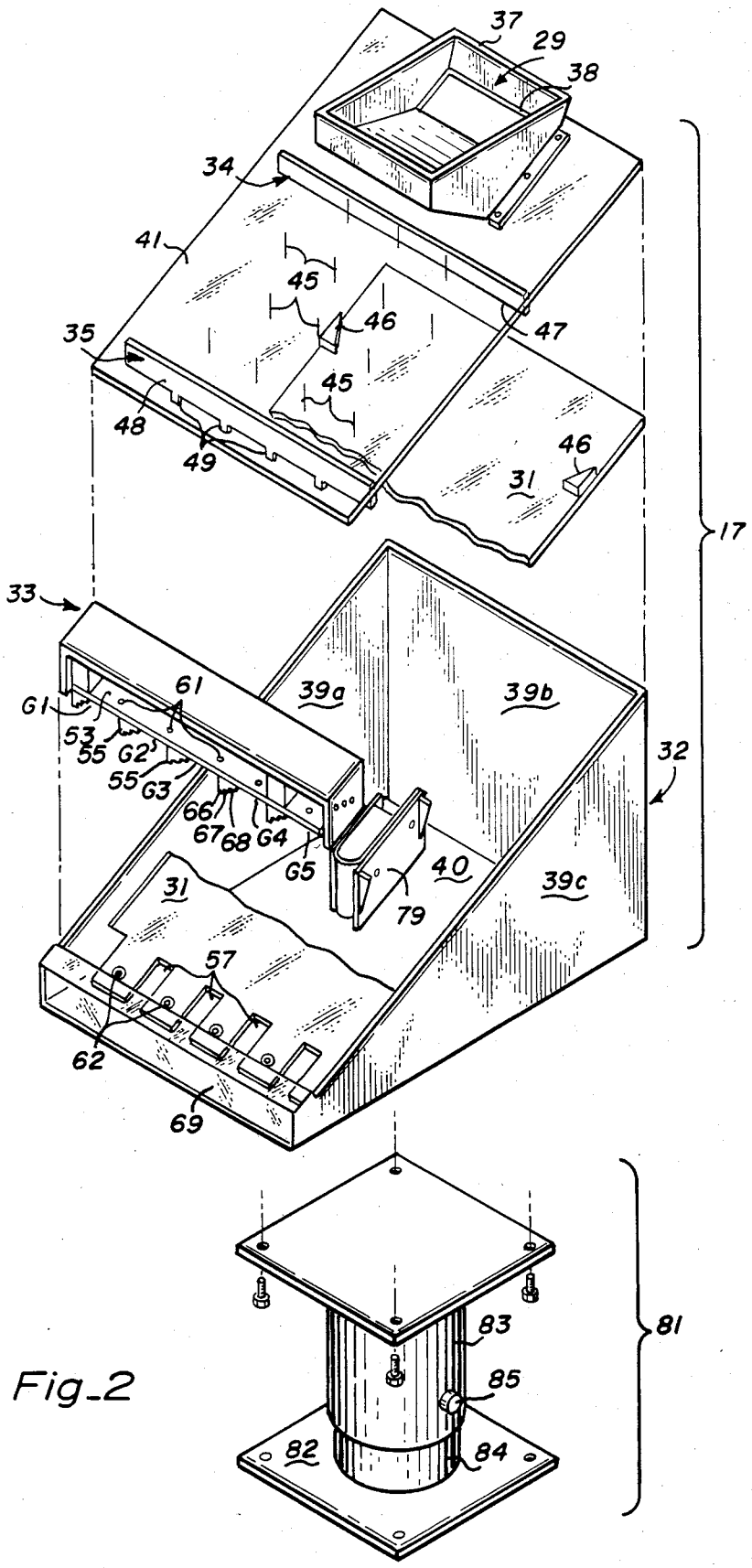
FIG. 2 is an exploded pictorial view of the coin-counting device FIG. 1.

Referring now to FIG. 2, the coin-counting device 17 generally includes a hopper 29 to receive a flow of coins, an inclined planar member 31 supported by a housing 32 to receive coins discharged by the hopper, and gate mechanism 33 mounted transversely across the lower end of the inclined planar member to count coins which slide down the planar member 31. (In the drawing of FIG. 2, for purposes of explanation, a portion of the inclined planar member 31 is shown mounted within the housing 32 and a portion is broken away to reveal the interior of the housing). Preferrably, a member 34 is provided to prevent coins from rolling down the inclined planar member 31, and a structure 35 is provided to prevent two coins from passing into the gate mechanism 33 atop one another. In practice, the hopper 29 has a relatively enlarged mouth 37 so that a number of coins may be received at the same time, and a relatively smaller or restricted discharge opening 38 to slow the flow of coins onto the inclined planar member 31.

In practice, the inclined planar member 31 is rectangular, and is mounted upon the supporting housing 32 such that it slopes downwardly at an angle from about twenty to thirty-five degrees from horizontal (preferably about twenty-eight degrees) without otherwise being canted. In otherwords, the planar member 31 is positioned such that a line drawn along its surface perpendicular to its longitudinal centerline would be horizontal. Also in practice, the planar member is usually about ten inches wide and about twelve inches long. In practice, a preferred material of construction is a Teflon-coated ABS plastic, but other materials having smooth and durable surfaces can be utilized.

Figure 3:
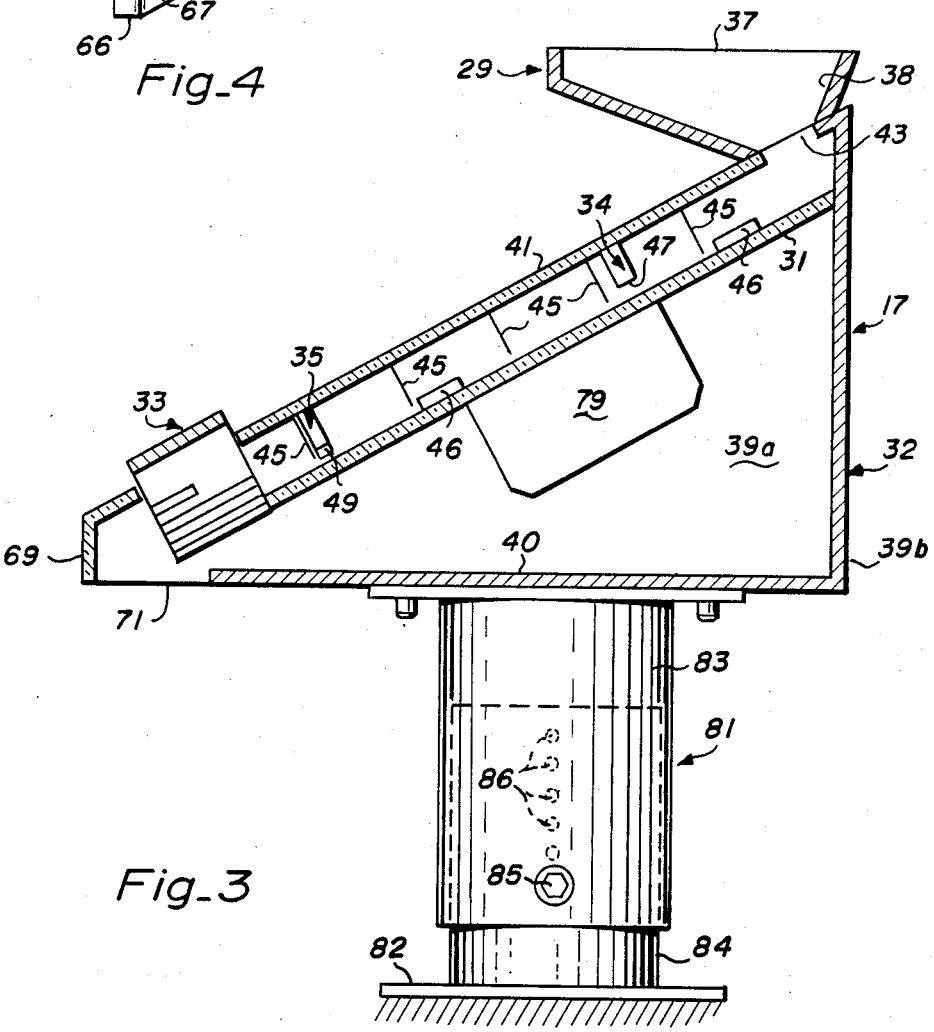
FIG. 3 is a side view, partially in section, of the device of FIG. 2 in assembled condition.

As shown in FIGS. 2 and 3, a cover member 41 is fixedly mounted to the housing 32 to extend generally parallel to the face of the inclined planar member 31 at a distance above the latter's surface. (For purposes of illustration only, the cover member 41 is shown as transparent). The hopper 29 is fixedly mounted about an opening 43 (FIG. 3) formed in the cover member 41 and located to discharge coins onto the upper end of the inclined planar member 31.

The housing 32 has upstanding sidewalls **39*a*, 39*b*, and 39*c* joined to a bottom wall 40. The sidewalls 39*a* and 39*c* preferrably have a right-triangular shape, and the hypotenuse of the triangle is parallel to the inclined planar member 31. In practice, the inclined planar member 31 is mounted within the housing such that the sidewalls 39*a*, 39*b* and 39*c* prevent coins from sliding off the respective sides and end of the planar member 31. Further in practice, the cover member 41 is mounted flush to the upper edges of the sidewalls 39*a*, 39*b* and 39*c* so that, in assembled condition, an enclosed chute is defined for coins to move from the hopper 29 to the lower end of the inclined plane member 31**.

As best shown in FIG. 2, an array of spaced-apart deflector pin members 45 are fixedly mounted to the undersurface of the cover member 41 to extend generally perpendicularly toward the surface of the inclined planar member 31. The purpose of the pin members 45 is to deflect and disperse sliding coins across the face of the inclined planar member 31, thus slowing the downward flow of the sliding coins. Preferrably, the pin members 45 are not fixed to the inclined planar member 31, but terminate close to its surface. Further, the pin members 45 are spaced from one another by a distance which allows sliding coins to pass between the pin members as the coins move from the upper end to the lower end of the inclined planar member 31. In practice, the spacing between the pin members 45, as measured laterally across the face of the inclined planar member 31, ranges from about 1.2 to 1.5 times the diameter of the coin to be counted; the smaller ratio is preferred with larger-diameter coins and tokens, and the larger ratio is preferred with smaller diameter coins. The spacing between the pin members 45 measured lengthwise of the planar member 31 can be approxiamtely the same or greater than the lateral spacing.

To further assist in dispersing coins sliding down the face of the inclined planar member 31, deflector members 46 can be mounted along the sidewalls **39*a* and 39*c* to project transversely of the face of the inclined planar member 41. The purpose of the deflector members 46 is to prevent coins from sliding uninterruptedly down the planar member along the sidewalls 39*a* and 39*c***.

The member 34 which prevents coins from rolling on the inclined planar surface 31 is a bar member mounted transversely across the underface of the cover member 41 near its upper end. The lower edge 47 of the bar member 34 is spaced from the planar member 31 by a distance which substantially exceeds the thickness, but not the diameter, of the coins to be counted. The bar member 34 can be called a "knockdown" bar to denote its function.

The structure 35 to prevent coins from entering the gate means 33 atop one another comprises an elongated member which is mounted near the lower end of the cover member 41 to extend transversely across the inclined planar member 31 and which includes tab portions 49 which extend downwardly and terminate above the face of the inclined planar member by a distance which only slightly exceeds the thickness of the coins to be counted. Thus, if two coins reach the member 35 with one of the coins sitting flatly atop the other, the tab members 49 will restrain the top coin until the lower coin slides free beneath the top coin. It is preferred that the tab members 49 have a certain resiliency which is sufficient to permit partially tilted coins to pass beneath the tab members under slight pressure; this is to prevent the coincounting from being jammed by tilted coins.

The gate mechanism 33, in the illustrated embodiment, includes a member 53 (see FIG. 2) which is mounted to extend transversely across the face of the inclined planar member 31, and a plurality of spacedapart partitioning members 55 mounted to the transverse member 53 to extend toward the face of the inclined planar member 31 to be received on spacedapart slots 57 formed in the inclined planar member 31. The spaces between adjacent partitioning members 55 define respective gates G1, G2, G3, G4 and G5 for the coins to slide through. Conventional optical sensors, each comprising an infra-red emitter 61 fixed to the transverse member 53 and a receiver 62 fixed opposite the emitter on the face of the inclined planar member 31, are mounted at locations generally midway between adjacent partitioning members 55 to sense the passage of coins through the respective gates G1–G5. A conventional electronic totallizer, not shown, is connected to the pairs of sensors to maintain a cumulative count of the coins which have passed the sensing means; that is, the totallizer adds the count of the coins which have been passed through the gate G1 (FIG. 2) to the count of coins which have passed through the gate G2 next on the right and so forth, until the counts for all of the gates have been added together.

Figure 4:
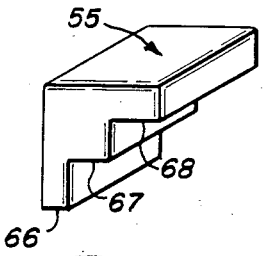
FIG. 4 is a pictorial view, to an enlarged scale, of a component of the coin counting device of FIG. 2.

As best shown in FIGS. 2 and 4, each of the partitioning members 55 preferrably has stepped portions 66, 67 and 68, and the transverse member 53 is mounted such that its distance above the surface of the inclined planar member 31 can be adjusted such that steps 66 are flush with the face of the inclined planar member 31, or the steps 67 are flush with the face of the planar member, or the steps 68 are flush with the face of the planar member. Accordingly, the effective width of the individual gates G1–G5 is determined by which of the steps 66–68 is flush with the face of the planar member 31. The gates G1–G5 will have the largest effective width when the steps 66 are flush with the face of the inclined planar member 31, and will have the narrowest effective width when the steps 68 are flush with the face of the planar member 31. Such adjustment of the effective width of the gates G1–G5 allows the gate mechanism 33 to be utilized with coins of different diameters (e.g., nickels, dimes and quarters) by a simple adjustment in the distance the transverse member 53 is spaced from the face of the inclined planar member 31. In practice, it has been found that one set of partition members can be used with nickles, dimes and quarters, and that a second set of partition members can be utilized for fifty-cent pieces, silver dollars and tokens.

As best shown in FIGS. 2 and 3, a deflecting hood 69 can be mounted to extend transversely across the discharge side of the gate mechanism 33 at a location spaced from the lower end of the inclined planar member 31 As so arranged, the deflecting hood defines a coin discharge opening 71 (FIG. 3).

Referring still to FIGS. 2 and 3, a vibrator mechanism 79 is mounted to the undersurface of the inclined planar member 31. In practice, the vibrator mechanism 79 is a conventional electromagnetic transformer device which gently vibrates the inclined planar member 31.

As shown in FIGS. 1–3, a pedestal 81 is provided to support the housing 32 at a selected height. The pedestal 81 includes a base member 82, a pair of cylindrical tubular members 83 and 84, one telescopically received within the other. The height of the pedestal is adjustable by placing a retaining bolt 85 in a selected one of a vertical series of aperture 86 (FIG. 3) formed through the sidewall of the inner cylindrical tubular member 84.

With the preceding description in mind, the function and operation of the coin-counting device 17 can be readily understood. In operation, a large number of coins can be received at the same time within the hopper 29, which serves the purpose of slowing the flow of coins as it discharges the coins through its bottom outlet 38 onto the upper surface of the inclined planar member 31. Upon striking the surface of the inclined planar member 31, the coins will begin to move downwardly on the face at a rapid rate. Although most of the coins will slide along the face of the inclined member 31, a certain percentage of the coins will begin to roll on edge. The rolling coins, after moving a short distance, will strike the edge 47 of the knock-down member 34, and thus, be forced to a sliding position. Coins which initially began sliding, rather than rolling, down the face of the inclined planar member 31 will move beneath the knock-down member 34 without striking it. The coins will be retained upon the surface of the inclined planar member 31 by the housing sidewalls **39*a* and 39*c*, the endwall 39*b*, and the cover member 41** which, in effect, define an enclosed chute for the coins.

After the sliding coins pass the knock-down member 34, the coins will encounter the array of deflector pin members 45. The pin members 45 serve the purpose of dispersing the coins transversely across the surface of the inclined planar member 31, so that the flow of coins is generally uniform across the face. In addition, impacts between the coins and the pin member 45 serve to minimize the number of coins reaching the lower end of the inclined planar member 31 riding atop one another. The pin members 45 do not engage the face of the inclined planar member 31 and, accordingly, their distal ends have some resiliency. Such resiliency has been found to substantially assist in distributing the coins across the face of the inclined planar member 31 as well as slowing the flow of coins downward.

After passing the array of pin members 45, the coins pass under the structure 35 which prevents coins from reaching the gate mechanism 33 atop one another. In situations where a coin is lying flat on top of another coin, the tab members 49 shear the top coin off the lower coin. However, in situations where one coin is riding on a second coin in a tilted position, the action is more complex. In some cases, the tab members 49 will knock the upper coin off the lower coin; in other instances, the two coins will lodge, or wedge, beneath the tab member momentarily until either knocked apart upon being struck by a third coin, or being dislodged by the vibratory action of the vibrator mechanism 79. In some instances, tilted coins will be pushed beneath the tab members 45 by the force of other coins sliding down the face of the inclined planar member 31.

In practice, it has been found desirable that the tab members 49 have a width of about 0.25 inches to 0.40 inches as measured transversely to the pitch of the face of the inclined planar member 31. Also in practice, the spacing between the tab members 49 is such that one tab member is centered for each gate G1–G5, respectively, defined between the partitioning member 55. Still further in practice, the vibrator 79 is operated periodically, e.g., fifteen seconds on and sixty seconds off, and may be actuated by a sensor device (not shown) which senses the passage of coins into the hopper 29. Thus, the vibrator mechanism 79 serves to further increase the distribution of coins laterally across the face of the inclined planar member 31 and to minimize the liklihood of coins becoming lodged in the counting device prior to reaching the gate mechanism 33.

After passing under the tab members 49, the coins will enter the gates G1–G5 defined between the partitioning members 55. In the embodiment illustrated, the widths of the gates G1–G5 can be adjusted to accommodate the diameter of the particular coins being counted. In practice, the width of each gate G1–G5, respectively, exceeds the coin diameter by about 0.1 inches.

As each coin passes through a respective gate G1–G5, its passage is registered by the electronic components connected to the optical emitters 61 and receivers 62; that is, the passage of a coin through a gate is registered by interruption of the optical signal (in practice, infra-red light) which is transmitted between the emitter 61 and the receiver 62 of the gate. In practice, each pair of the emitters and transmitters is on a separate counting channel so that, if two coins pass through two respective gates G1–G5 at the same time, there will be no counting error. Subsequently, the counts for the individual gates G1–G5 are added together, in the electronic totallizer or the like, and the results recorded. After leaving the gate mechanism 33, the coins strike the hood member 69 and are deflected downward through the discharge opening 71 for collection.

In practice, the device of the present invention has proven to be essentially 100% accurate, even when fifty or more coins are occasionally deposited into the hopper 29 simultaneously.

Although the present invention has been described with particular reference to the illustrated preferred embodiment, it is to be understood that such disclosure is not to be interpreted as limiting. Various other alterations, modifications and embodiments will no doubt become apparent to those skilled in the art after having read the preceding disclosure. Accordingly, it is intended that the appended claims be interpreted as covering all such alterations, modifications and embodiments as fall within the true spirit and scope of the present invention.

We claim:

1. In a coin-activated machine:

a coin-receiving device for accepting coins of a selected denomination;

coin reservoir means mounted within the coin-receiving device for collecting said accepted coins;

a coin-counting device mounted in coin-flow communication with the reservoir means for receiving and counting coins which spill over from the reservoir means, the counting device including:

hopper means in spill over relation to the coin reservoir means to receive said coins spilling over from the reservoir means, the hopper means having an outlet for said coins;

an inclined planar member mounted to receive, at its upper ends, coins at said outlet of the hopper means to provide a face for coins to slide upon;

gate means mounted at spaced-apart locations transversely across the lower end of the inclined planar menber to count coins sliding downward on said face of the inclined planar member;

means mounted to extend across the inclined planar member at a distance thereabove sufficient to prevent two or more coins from sliding one atop the other, into the gate means; and a plurality of spaced-apart resilient pin members mounted to extend downwardly toward said face of the inclined planar member and terminate less than one coin width distance above said face of the inclined planar member such that coins sliding down said face of the inclined planar member strike said pin members and are dispersed laterally across said face.

2. A coin activated machine according to claim 1, further including:

a plurality of triangular-shaped side deflector members positioned near the side edges of the inclined planar member such that coins sliding down the planar member near the side edges strike the side deflector menbers and are deflected toward the center of the planar member.

3. A coin-activated machine according to claim 1 wherein;

said pin members of said plurality are spaced from one another laterally across the face of the planar inclined member by a distance ranging from about 1.2 to 1.5 times the diameter of said coin to be counted.

4. A coin-counting device according to claim 1 further including:

a cover metber mounted to extend generally parallel to said face of the inclined planar member at a distance thereabove, and said plurality of pin members is fixed to the cover member.

5. A machine for counting coins of a selected denomination comprising:

(a) hopper means to receive a flow of coins;

(b) an inclined planar member mounted to receive, at its upper end, coins at the outlet of the hopper means and to provide a face for said coins to slide upon;

(c) means mounted to extend across said face of the inclined planar member at a distance thereabove sufficient to prevent two or more coins from sliding, one atop the other, down said face of the inclined planar member;

(d) sidewall and cover members to define, in conjunction with the inclined planar member, an enclosed chute for the coins to slide down;

(e) an array of spaced-apart deflector means mounted to said cover member to extend downwardly toward said face of the inclined planar member terminating less than one coin width distance above said face of the inclined planar member, to strike coins sliding down the inclined planar member to laterally disperse said coins across the face of the inclined planar member; and (f) gate means mounted at spaced-apart locations transversely across the lower end of the inclined planar member to count coins sliding downward on said face of the inclined planar member.

6. A coin-counting device according to claim 5 wherein;

the deflector means are pin members spaced from one another laterally across the face of the planar inclined member by a distance ranging from about 1.2 to 1.5 times the diameter of said coin to be counted.

7. A coin machine according to claim 5, further including;

a plurality of triangular-shaped side deflector members positioned near the side edges of the inclined planar member such that coins sliding down the planar member near the side edges strike the side deflector members and are deflected toward the center of the planar member.

8. A coin-connecting device according to claim 6 further including;

a member mounted to extend transversely above the face of the inclined planar member at a height to strike coins rolling on edge down the face of the inclined planar member.

9. A coin-counting device of the type which counts a number of coins, all of the same denomination, at the same time, comprising:

(a) hopper means to receive a number of coins at the same time;

(b) an inclined planar member mounted to receive, at its upper end, coins at the outlet of the hopper means and to provide a face for said coins to slide upon;

(c) gate means mounted at spaced-apart locations transversely across the lower end of the inclined planar menber to provide a plurality of gates through which coins sliding downward on said face of the inclined planar member are counted;

(d) means mounted to extend across said face of the inclined planar member at a distance thereabove sufficient to prevent two or more coins from sliding, one atop the other, into the gate means; and (e) an array of spaced-apart deflector means mounted to extend downwardly toward said face of the inclined planar menber terminating less than one coin width distance above said face of the inclined planar member, to strike coins sliding down the inclined planar member to laterally disperse said coins across the face of the inclined planar member.

10. A coin-activated machine according to claim 9 wherein;

the deflector means are pin members which are spaced from one another laterally across the face of the planar inclined member by a distance ranging from about 1.2 to 1.5 times the diameter of said coin to be counted.

11. The device of claim 9, further including;

a plurality of triangular-shaped side deflector members positioned near the side edges of the inclined planar member such that coins sliding down the planar member near the side edges strike the side deflector members and are deflected toward the center of the planar member.

12. A coin-counting device according to claim 10 further including;

a cover member mounted to extend generally parallel to said face of the inclined planar member at a distance thereabove, and said plurality of pin members is fixed to the cover member.

13. A coin-counting device according to claim 9 wherein;

the means to prevent coins from sliding atop one another comprises spaced-apart tab members mounted to extend downwardly toward said face of the inclined planar member.

14. A coin-counting device according to claim 13 wherein;

said tab members range in width from about 0.25 inches to 0.40 inches as measured transverse to said face of the inclined planar member, and each tab member is centered with respect to the entry to each of said gates.

15. A coin-counting device according to claim 14 wherein;

the width of each gate of said plurality exceeds the diameter of the coin to be counted by about 0.1 inches.

16. A coin-counting device according to claim 13 further including;

vibrator means connected to the inclined planar member.

17. A coin-counting device of the type which counts a number of coins, all of the same denomination, at the same time, comprising:

(a) hopper means to receive a number of coins at the same time;

(b) an inclined planar member mounted to receive, at its upper end, coins at the outlet of the hopper means and to provide a face for said coins to slide upon;

(c) gate means mounted at spaced-apart locations transversely across the lower end of the inclined planar member to provide a plurality of gates through which coins sliding downward on said face of the inclined planar member are counted;

(d) means mounted to extend across said face of the inclined member at a distance thereabove sufficient to prevent two or more coins from sliding, one atop the other, into the gate means;

(e) an array of spaced-apart deflector means mounted to extend downwardly toward said face of the inclined planar member to strike coins sliding down the inclinded planar member to disperse said coins across the face of the inclined planar member; and (f) spaced-apart partitioning members fixedly mounted to extend laterally across said face of the inclined planar member to define the individual gates of said plurality, each partitioning member comprises a member having a stepped portions, and slots are formed in said face of the inclined planar member to receive said stepped portions.

18. A coin-counting device according to claim 17 wherein;

the effective width of said individual gates is adjustable and determined by which step of said stepped partitioning pieces is located flush with said face of the inclined planar member.

19. A coin-counting device of the type which counts a number of coins, all of the same denomination, at the same time, comprising:

(a) hopper means to receive a number of coins at the same time;

(b) an inclined planar member mounted to receive, at its upper ends, coins at the outlet of the hopper means and to provide a face for said coins to slide upon;

(c) gate means mounted at spaced apart locations transversely across the lower end of the inclined planar member to provide a plurality of gates through which coins sliding downward on said face of the inclined planar member are counted;

(d) means mounted to extend across said face of the inclined planar member at a distance thereabove sufficient to prevent two or more coins from sliding, one atop the other, into the gate means;

(e) an array of spaced-apart pin members which are spaced from one another laterally across the face of the inclined planar member by a distance ranging from about 1.2 to 1.5 times the diameter of said coin to be counted, the pin metbers mounted to extend downwardly toward said face of the inclined planar member to strike coins sliding down the inclined planar member to disperse said coins across the face of the inclined planar member;

(f) a cover member mounted to extend generally parallel to said face of the inclined planar member at a distance thereabove, and said plurality of pin members is fixed to the cover merber; and (g) a telescoping pedestal to adjustably support the inclined planar member.

* * * * *